US005442421A

United States Patent [19]

Kojima

[11] Patent Number: 5,442,421

[45] Date of Patent: Aug. 15, 1995

[54] PROCESS CARTRIDGE AND IMAGE FORMING APPARATUS USING THE SAME

[75] Inventor: Hisayoshi Kojima, Yokohama, Japan

[73] Assignee: Canon Kabushiki Kaisha, Japan

[21] Appl. No.: 38,058

[22] Filed: Mar. 30, 1993

Related U.S. Application Data

[63] Continuation of Ser. No. 765,010, Sep. 24, 1991, abandoned.

[30] Foreign Application Priority Data

Oct. 1, 1990 [JP] Japan ..... 2-260564

[51] Int. Cl.[6] ..... G03G 5/00; G03G 15/048; G03G 15/056

[52] U.S. Cl. ..... 355/211; 355/200; 355/260; 355/326 R

[58] Field of Search ..... 355/200, 260, 326, 210, 355/211, 327, 250, 251, 259, 253, 245; 118/651, 656, 657

[56] References Cited

U.S. PATENT DOCUMENTS

| | | | |
|---|---|---|---|
| 4,373,468 | 2/1983 | Suda et al. | 118/658 |
| 4,395,476 | 7/1983 | Kanbe et al. | 430/102 |
| 4,515,465 | 5/1985 | Miyoshi et al. | 355/245 |
| 4,639,119 | 1/1987 | Isaka | 355/300 |
| 4,924,267 | 5/1990 | Yoshikawa et al. | 355/210 |
| 4,928,144 | 5/1990 | Kasahara | 355/245 |
| 5,061,968 | 10/1991 | Kita | 355/326 |
| 5,170,209 | 12/1992 | Tompkins et al. | 355/200 |
| 5,249,026 | 9/1993 | Kojima | 355/327 |

FOREIGN PATENT DOCUMENTS

| | | |
|---|---|---|
| 60-60768 | 4/1985 | Japan . |
| 2-25713 | 1/1990 | Japan . |
| 2-228413 | 9/1990 | Japan . |

*Primary Examiner*—A. T. Grimley
*Assistant Examiner*—Shuk Y. Lee
*Attorney, Agent, or Firm*—Fitzpatrick, Cella, Harper & Scinto

[57] ABSTRACT

A process cartridge has an electrophotographic photoconductive member and a developing device for developing a latent image on the photoconductive member as a unit and which is detachable from the apparatus body, and a multiple image forming apparatus with the cartridge mounted therein. Since a contact portion for bringing a developing agent bearing member of a developing device in the apparatus body into contact with the process cartridge is disposed on the side of the process cartridge, it is possible to improve the positioning accuracy of the photoconductive member in the cartridge and the developing device in the apparatus body.

45 Claims, 7 Drawing Sheets

PROCESS CARTRIDGE AND IMAGE FORMING APPARATUS USING THE SAME

This application is a continuation application Ser. No. 07/765,010 filed Sep. 24, 1991, now abandoned.

BACKGROUND OF THE INVENTION

Field of the Invention

The present invention relates to an image forming apparatus for forming a multiple image on a transfer material, such as a color copying machine or a color printer, each using electrophotography.

Description of the Related Art

FIG. 9 is a cross-sectional view showing the principal construction of a color image forming apparatus, proposed by the applicant of the present invention in U.S. patent application Ser. No. 642,895 (abandoned in favor of continuation application Ser. No. 946,161, filed Sep. 17, 1992, assigned to Group Art Unit 2101), for forming a multiple image, to which the present invention is applicable.

The illustrated multiple image forming apparatus 100 forms a color image on a transfer material with color developing agents based on color image information from an image reader or a computer.

The color image information is input to a laser optical system 101, and a photoconductive drum 102 is scanned with light corresponding to the information by driving the laser optical system 101 according to of the color information signals. In an image forming station using electrophotography, the photoconductive drum 102, a charger 103, a developing device 104 and a cleaning device 105 are formed as a unit to constitute a cartridge 106 which is detachable from the body of the apparatus. The developing device 104 is composed of developing units 104Y, 104M and 104C which contain developing agents of three colors, yellow, magenta and cyan, respectively, and which separately operate with respect to the photoconductive drum 102. A developing unit 107 for black is located under the cartridge 106 on the side of the apparatus body.

On the other hand, a transfer drum 108 is located opposite to the photoconductive drum 102. Transfer materials 110 are supplied onto the transfer drum 108 one by one from a sheet feeding cassette 109, and then held on the surface of the transfer drum 108. A corona charger 111 is located opposite to the photoconductive drum 102 through the transfer material supporting face of the transfer drum 108.

A fixing device 112 having heat rollers is disposed downstream from the transfer drum 108 in the transfer material transport path.

The operation of forming a two-color multiple image on the transfer material 110 with magenta and black developing agents in using the above-described apparatus will now be described.

When a control means determines that an image forming operation is started, the photoconductive drum 102 is rotated clockwise and uniformly charged by the charger 103. Signals corresponding to a magenta image are input to the optical system 101, and the uniformly charged photoconductive drum 102 is scanned with information light corresponding to the magenta signals, thereby forming a latent image on the photoconductive drum 102. The latent image corresponding to the magenta image is developed by the magenta developing unit 104M, and the developed magenta image is transferred onto the transfer material 110 held on the transfer drum 108 by an electrostatic field made by the transfer charger 111.

After image transfer is completed, the residual developing agent on the photoconductive drum 102 is removed by the cleaning device 105, and the photoconductive drum 102 is uniformly charged again by the charger 103 in preparation for the next image formation with a black developing agent. Then, signals corresponding to a black image are input to the optical system 101, and the photoconductive drum 102 is scanned with information light corresponding to the black signals, thereby forming a latent image. This latent image is developed by the black developing unit 107 in the apparatus body.

At this time, the transfer material 110 bearing the developed magenta image and held on the photoconductive drum 102 is moved to the transfer position again in correlation to the rotation of the transfer drum 108, and then, the developed black image is transferred onto the transfer material 110 by an electrostatic field made by the transfer charger 111.

Next, the transfer material 110 bearing an unfixed multiple image developed with magenta and black developing agents is forcibly separated from the transfer drum 108 by a separating member 113 and the multiple image is fixed by the fixing device 112. After the fixing process is completed, the transfer material 110 is supplied onto a sheet eject tray 114 outside the apparatus body.

The formation of a multi-color image is performed by superposing images, which are developed by the yellow, magenta, cyan and black developing units, on the transfer material 110. The details of the principle of the multiple image formation and the developing method of a multiple image are apparent from the application of the prior art, and therefore the description of them is omitted.

In the case where an image forming apparatus which performs non-contact development, such as the jumping development method disclosed in, for example, U.S. Patent No. 4,395,476 by the applicant of the present invention, is adopted to develop a latent image formed by electrophotography on the photoconductive drum in the above-described image forming apparatus, as shown in FIG. 9, it is important to accurately maintain a constant interval between the the electrophotographic photoconductive drum serving as an image bearing member and a developing roller serving as a developing agent bearing member, such as a non-magnetic sleeve and a magnetic roller. Conventionally, in order to keep the interval constant, the following methods have been carried out. For example, caps serving as spacers and each having a thickness corresponding to a predetermined interval are put on the peripheries of the developing roller at both ends and brought into contact with the photoconductive drum as disclosed in Japanese Laid-open Patent No. 60-60768. Rollers each having a radius a predetermined distance longer than the radius of a developing roller are rotatably held on shafts of the developing roller at both ends and brought into contact with the photoconductive drum as disclosed in U.S. Pat. No. 4,373,468, and respective shafts of a photoconductive drum and a developing roller are held through a bearing by an interval adjustment member, which is accurately manufactured or adjustable.

However, in an image forming apparatus which forms images of a plurality of colors, such as yellow, magenta, cyan and black, on the same transfer material, if at least a photoconductive drum and a plurality of developing units of the above colors constitute an integral cartridge, it is expected that the amounts of toners to be consumed will differ according to the color. In order to reduce the amount of unused toner when such a cartridge is replaced with another, it seems effective to put only black toner, which is especially frequently-used, in a detached cartridge. In such an arrangement, a developing roller in the black developing unit as a detached cartridge and the photoconductive drum cannot be supported by a single supporting member, and therefore, the above method of letting the interval adjustment member support the shafts of the photoconductive drum and the developing roller through a bearing is difficult to carry out.

Furthermore, in order to form a good image on a transparent transfer material, it is preferable to use a toner having excellent light transmittance, that is, a toner which melts well at low temperatures. However, in the case of such a toner, if the two former methods of the above interval maintaining methods, that is, the method of bringing caps into contact with the photoconductive drum, and the method of putting the rollers on the shafts of the developing roller at both ends, are carried out, scattered toner particles and the like are put between the photoconductive drum and the contact caps or rollers. Since the toner particles are easily fused due to pressure and frictional heat from the photoconductive drum, the image may be made uneven due to the resulting increase of the interval between the photoconductive drum and the developing roller, or due to partial fusion of the toner.

SUMMARY OF THE INVENTION

With the above problems in view, an object of the present invention is to provide an image forming apparatus capable of preventing the change of a development gap resulting from the fusion of a scattering developing agent and so on and always stably obtaining a good multiple image on a transfer material.

In order to achieve the above object, the present invention relates to a process cartridge which supports both an electrophotographic photoconductive member and a process means as a unit and which is detachable from the body of the apparatus, and a multiple image forming apparatus provided with the cartridge therein. The accuracy in positioning the photoconductive member in the cartridge and a developing means in the body of the apparatus can be enhanced by mounting a contact portion for bringing a developing agent bearing means of the developing means disposed in the apparatus body into contact with the cartridge, on the side of the cartridge.

The present invention, according to one aspect, relates to a process cartridge detachable from the body of an image forming apparatus comprising an image carrier, a frame supporting the image carrier, and developing means for forming a visible image on the image carrier. The developing means is formed separately from the frame and includes a developing agent bearing member for supplying a developing agent to the image carrier. The frame comprises locating means for locating the developing agent bearing member.

According to another aspect, the present invention relates to an image forming apparatus comprising a process cartridge and means for detachably mounting the process cartridge. The process cartridge comprises an image carrier, a frame supporting the image carrier, and developing means for forming a visible image on the image carrier, the developing means being formed separately from the frame and including a developing agent bearing member for supplying a developing agent to the image carrier. The frame comprises locating means for locating the development agent bearing member.

DETAILED DESCRIPTION OF THE PREFERRED EMBODIMENTS

The preferred embodiments of the present invention will now be described with reference to the accompanying drawings.

Figure 1:
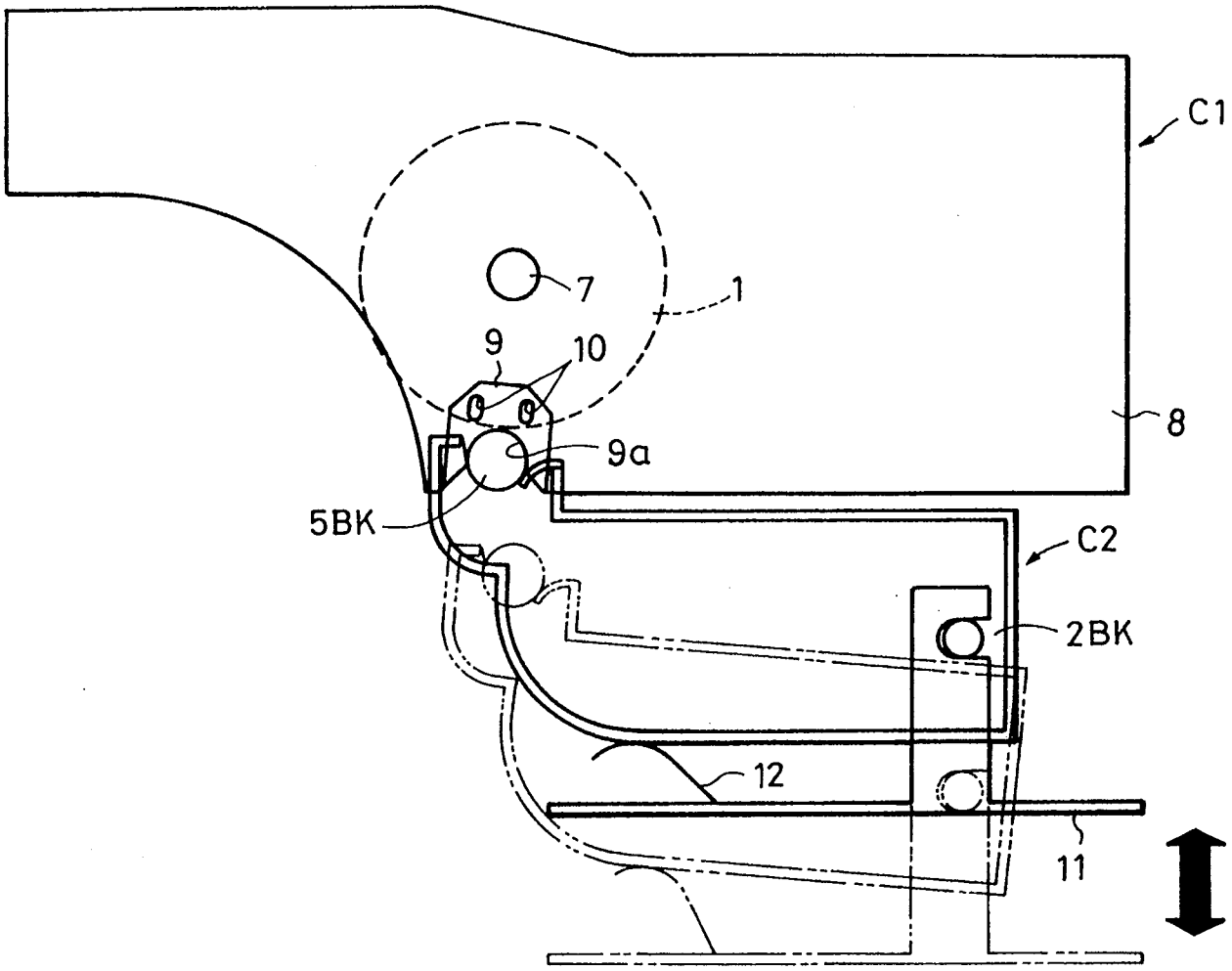
FIG. 1 is a front view of cartridges in a color image forming apparatus according to the present invention.
Figure 2:
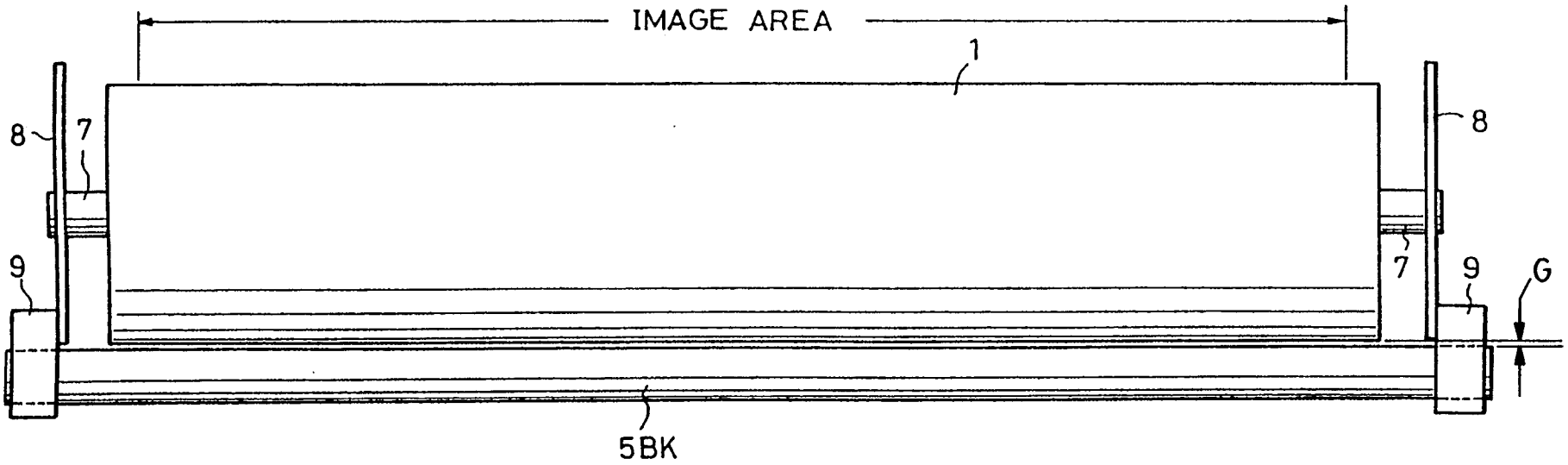
FIG. 2 is a partial plan view showing the positioning state of a development roller with respect to a photoconductive drum.
Figure 3:
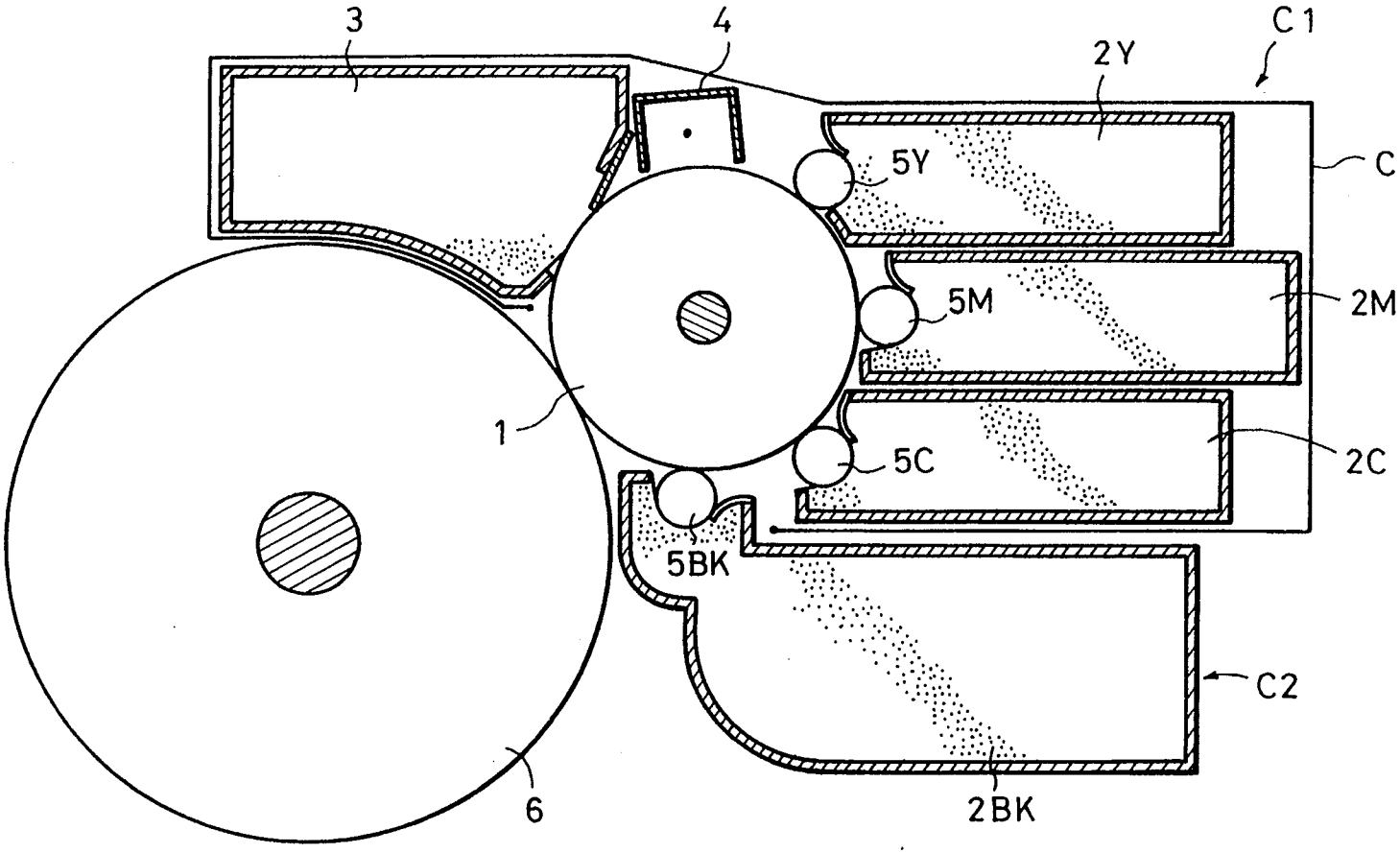
FIG. 3 is a front view of the principal part of the color image forming apparatus.

FIG. 1 is a front view of cartridges of a color image forming apparatus according to the present invention, FIG. 2 is a partial plan view showing the positioning state of a developing roller with respect to a photoconductive drum, and FIG. 3 is a front view of the principal part of the color image forming apparatus.

Figure 9:
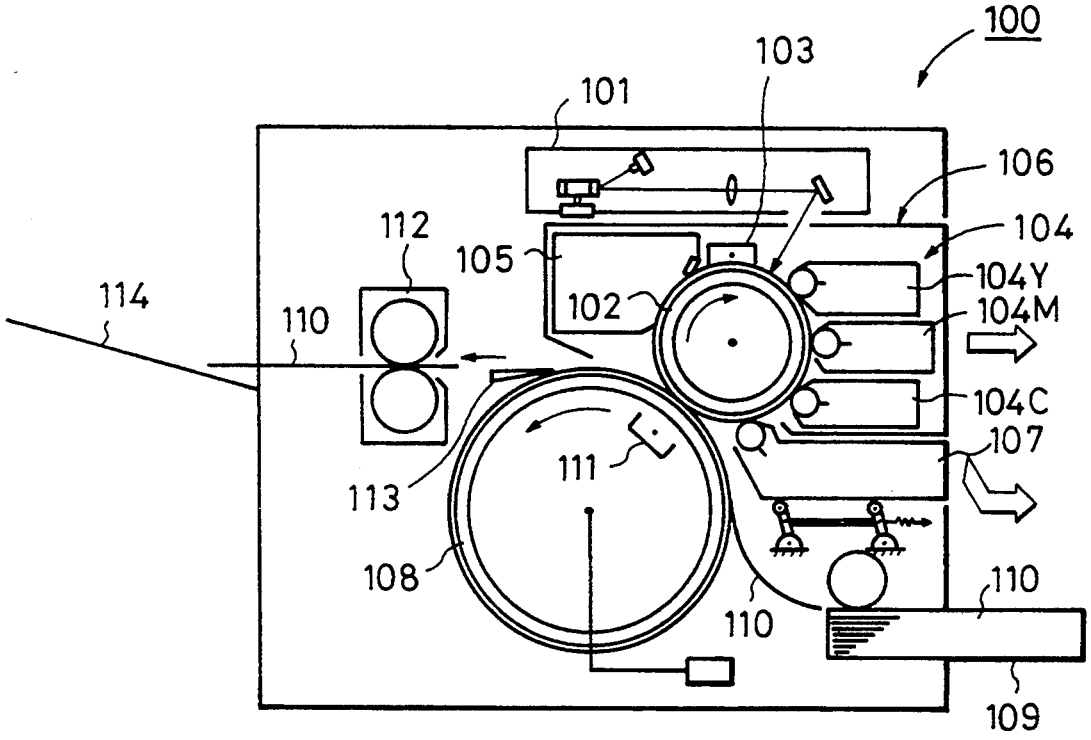
FIG. 9 is a cross-sectional view of the principal part of an apparatus for forming a multi-color image according to an embodiment of a multiple image forming apparatus to which the present invention is applied.

The color image forming apparatus of the present invention is separately provided with a main cartridge C1 and a sub-cartridge C2 in the body shown in FIG. 9. The main cartridge C1 in FIG. 1 corresponding to the cartridge 106 in FIG. 9 is formed with an electrophotographic photoconductive drum 1 serving as an image bearing member, a plurality of developing units 2Y, 2M and 2C for yellow, magenta and cyan, a cleaner 3 for sliding an elastic blade, and a charger 4 for uniformly charging the photoconductive drum 1 which are incorporated as a unit into a support member C. The sub-cartridge C2 consists of only a developing unit 2BK for black. The main cartridge C1 and the sub-cartridge C2 are separately detachable from the apparatus body according to the construction described below.

The developing units 2Y, 2M and 2C in the main cartridge C1 contain a yellow toner, a magenta toner and a cyan toner, respectively, and the developing unit 2BK in the sub-cartridge C2 contains a black toner. When the main cartridge C1 and the sub-cartridge C2 are mounted in the apparatus body as shown in FIG. 3, developing rollers 5Y, 5M, 5C and 5BK, serving as developing agent bearing members in the developing units 2Y, 2M, 2C and 2BK, are kept out of contact with the photoconductive drum 1. Referring to Fig. 3, numeral 6 denotes a transfer drum mounted in the apparatus body corresponding to the transfer drum 108 shown in FIG. 9.

A well-known developing roller using a conventional one-component or two-component developing agent is applicable as the above developing roller. For example, a magnetic roller, and a cylindrical development sleeve formed of a non-magnetic member mounted on the periphery of a magnetic member may be used. These developing rollers are rotated by the driving force from the apparatus body or the photoconductive drum 1 through an unillustrated gear and the like. Applicable driving means for performing such a drive operation are disclosed in, for example, Japanese Patent Application Nos. Hei 2-25713 and 2-228413.

As shown in FIG. 1, a drum shaft 7 of the photoconductive drum 1 is rotatably supported by side plates 8 which constitute a part of a frame in the main cartridge C1, and contact members 9 for urging the developing roller 5BK in the sub-cartridge C2 are fixed to the side plates 8. The contact members 9 are disposed in a non-imaging area of the photoconductive drum 1 outside the side plates 8. Furthermore, each of the contact members 9 is formed of a bearing member of resin or metal, and, the surface of a U-shaped engaging slot 9*a* which the developing roller 5BK engages is coated with a material having low frictional coefficient, such as a PTFE resin in order to enhance slidability.

In this embodiment, the contact member 9 is fixed to the side plate 8 by unillustrated screws which pierce two long holes 10, and thereby the fixing position of the contact member 9 with respect to the side plate 8 can be adjusted so that a predetermined interval is formed between the developing roller 5BK and the photoconductive drum 1 when the developing roller 5BK engages the engaging portion 9*a*. If the positional relationship between the side plate 8 and the contact member 9 is predetermined with high accuracy, the contact member 9 may be fixed to the side plate 8 with an adhesive.

After the sub-cartridge C2 is, as shown in FIG. 1, inserted in a sub-cartridge mount table 11 movably supported by the body of the image forming apparatus shown in FIG. 9, the sub-cartridge mount table 11 and the sub-cartridge C2 are moved from a position indicated by a dashed line to a position indicated by a solid line shown in FIG. 1, thereby mounting the sub-cartridge C2 in the apparatus body. Next, the developing roller 5BK of the sub-cartridge C2 is pressed by a spring 12 against the engaging portion 9*a* of the contact member 9 in the main cartridge C1 preset in the apparatus body so as to be in linear contact with the engaging portion 9*a* and positioned. At this time, although it is possible that a contact shaft is mounted to the developing roller 5BK and the contact member 9 is brought into contact with the contact shaft, if the contact member 9 is in direct contact with the periphery of the developing roller 5BK as shown in FIG. 2, it is possible to reduce changes of the interval between the developing roller 5BK and the photoconductive drum 1 by only reducing the run-out of the peripheral surface of the developing roller 5BK without any effect on the coaxiality of the contact shaft and the developing roller 5BK.

According to the above arrangement, since the photoconductive drum 1 and the developing roller 5BK are always in no contact with each other and a sliding portion (the engaging portion 9*a* of the contact member 9) can be placed outside the photoconductive drum 1, the interval between the photoconductive drum 1 and the developing roller 5BK is prevented from being changed due to the fusion of scattered toner, and thus a good color image can be always obtained. Furthermore, the main cartridge C1 and the sub-cartridge C2 can be separately detached from the apparatus body.

The developing roller 5BK in the sub-cartridge C2 and the photoconductive drum 1 in the main cartridge C1 are positioned as described above. The positioning accuracy of the photoconductive drum 1 and the developing roller 5BK is determined by the run-out of the surface of the photoconductive drum 1 and the drum shaft 7, the mounting accuracy of the contact member 9 with respect to the side plate 8 and the run-out of the peripheral surface of the developing roller 5BK. In order to maintain a constant interval between the photoconductive drum 1 and the developing roller 5BK with high accuracy, it is important to reduce the run-out of the surface of the photoconductive drum 1 and the drum shaft 7 and the peripheral surface of the developing roller 5BK to a minimum. In addition, the drum shaft 7 may be pressed by an unillustrated spring or the like in order to remove the vibration arising from the drive of the photoconductive drum 1 when the drum shaft 7 and the side plate 8 engage each other.

Figure 4:
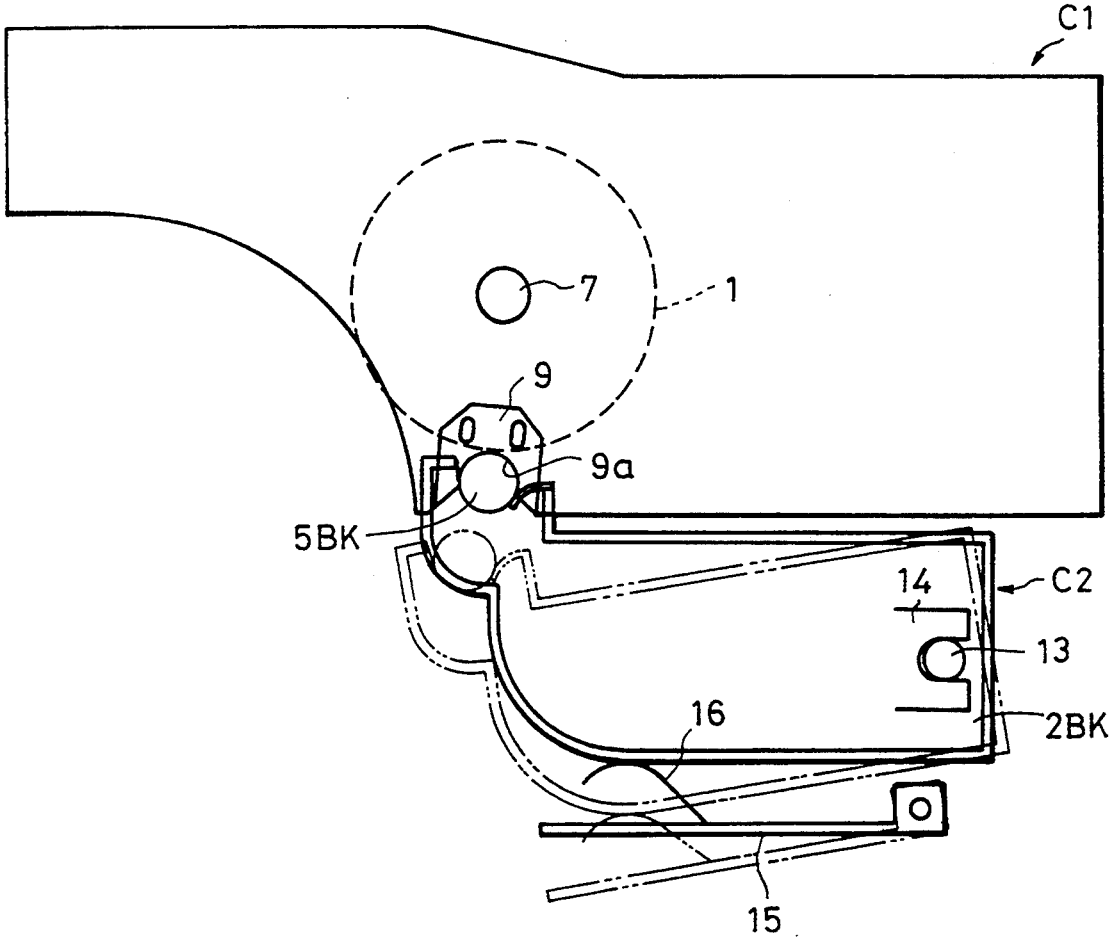
FIG. 4 is a front view of cartridges according to a second embodiment of the present invention.

A second embodiment of the present invention is shown in FIG. 4.

In this embodiment, the sub-cartridge C2 is rotatably in the apparatus body. A rotary shaft 13 of the sub-cartridge C2 is fitted into a sub-cartridge mount table 14 which is disposed in the apparatus body, and the sub-cartridge C2 is rotatable on the rotary shaft 13. The rotation of a sub-cartridge lifting table 15 from a position indicated by a chain line to a position indicated by a solid line rotates the sub-cartridge C2 on the rotary shaft 13 from a position indicated by a chain line to a position indicated by a solid line, thereby pressing and positioning the developing roller 5BK in the sub-cartridge C2 by a spring 16 against the engaging portion 9*a* of the contact member 9.

Figure 5:
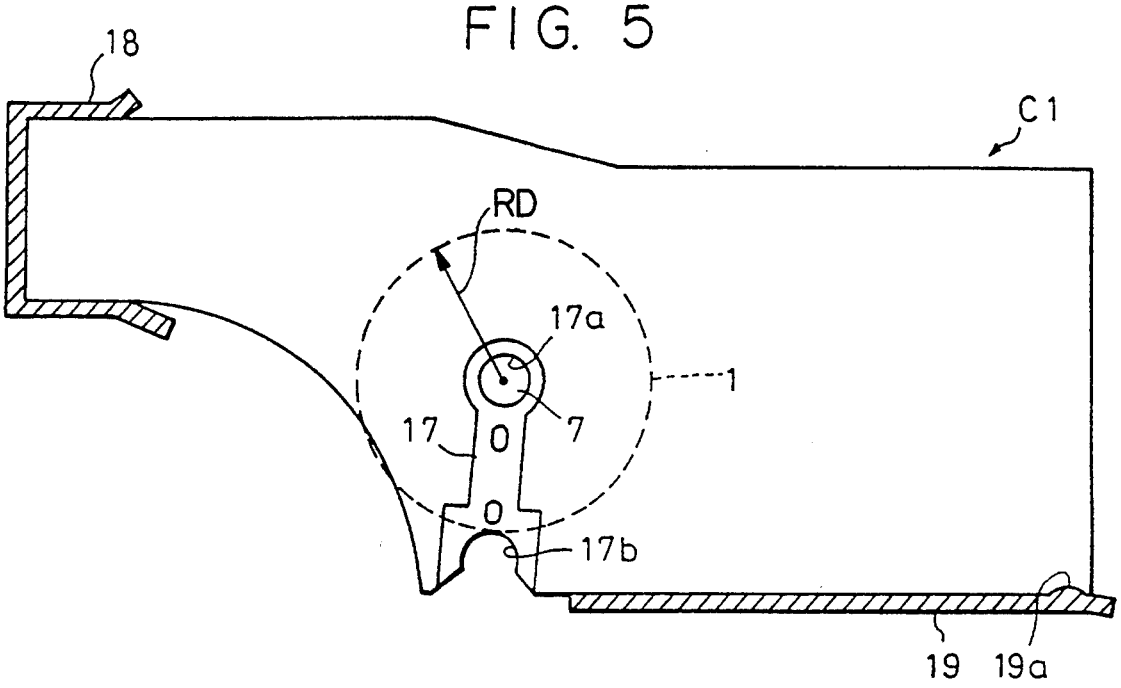
FIG. 5 is a front view of a main cartridge according to a third embodiment of the present invention.
Figure 6:
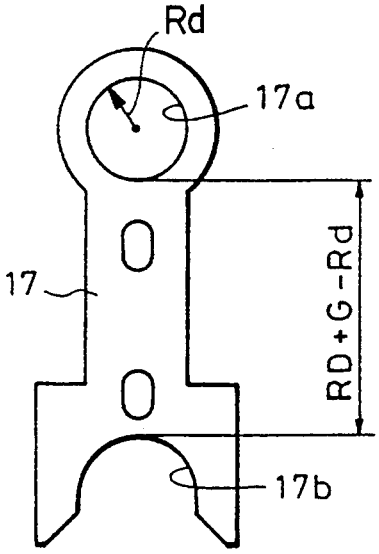
FIG. 6 is a front view of a contact member.

FIGS. 5 and 6 each show a third embodiment of the present invention.

In this embodiment, a contact member 17 supports and positions both the drum shaft 7 of the photoconductive drum 1 and an unillustrated developing roller. In other words, the contact member 17 has a circular hole 17a for rotatably supporting the drum shaft 7 and an engaging portion 17b for supporting the peripheral surface of the developing roller.

If the above contact member 17 is used the distance shown in FIG. 6, that is, the distance (the radius RD of the photoconductive drum 1) + (the gap G) − (the radius Rd of the drum shaft 7) is maintained with high accuracy, since high accuracy can be obtained by only bringing the peripheral surface of the drum shaft 7 and the peripheral surface of the developing roller into contact with the contact member 17, providing the advantage that the contact member 17 can be attached to the side plate 8 without any particular adjustment.

Figure 7:
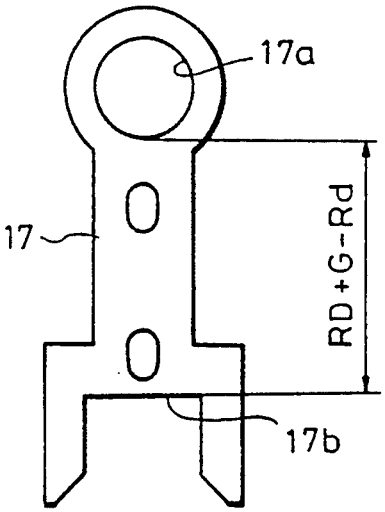
FIG. 7 is a front view of a variation of the contact member.

Since the contact member 17 is adapted to adjust the minimum interval between the peripheral surface of the drum shaft 7 and the peripheral surface of the developing roller, the engaging portion 17b of the contact member 17 is not required to be arcuate, and may be linear as shown in FIG. 7.

Guide members 18 and 19 shown in FIG. 5 guide and position the main cartridge C1 used in common in all the above embodiments. When the main cartridge C1 is mounted in the apparatus, it is guided by the guide member 19 to a predetermined position in the apparatus body and stopped by the guide member 18. At this time, an inside convex portion 19*a* of the guide member 19 engages a concave portion of the main cartridge C1 so as to prevent the inadvertent detachment of the main cartridge C1.

Figure 8:
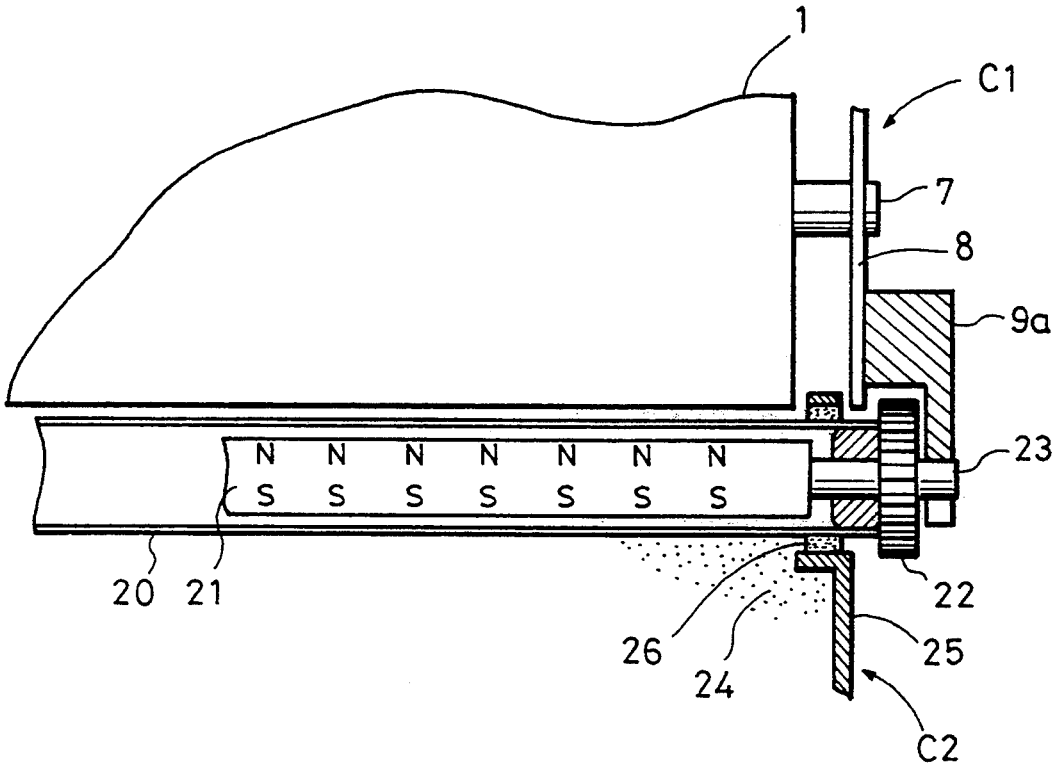
FIG. 8 is a partial plan view of a fourth embodiment of the present invention.

FIG. 8 shows a fourth embodiment of the present invention. The photoconductive drum 1 and the developing roller are positioned by a magnetic developing roller.

A non-magnetic sleeve 20 formed of, for example, stainless steel, has a magnet 21 fixed to a shaft 23 fixed inside thereof. A resin gear 22 serving as a flange is located at the end of the sleeve 20 so as to drive the sleeve 20. The gear 22 is slidable on the shaft 23. A developing agent 24 is contained in a container 25 of the sub-cartridge C2 and prevented from escaping outside by a flexible member 26, such as a sponge, disposed between the sleeve 20 and the container 25.

In this embodiment, the positioning is performed by bringing the shaft 23 into contact with the contact member 9*a* of the main cartridge C1.

According to the present invention as described in detail above, in a color image forming apparatus which has a main cartridge composed of at least an image bearing member and a developing unit, and a sub-cartridge composed of a developing unit containing a developing agent of a color different from that of a developing agent contained in the developing unit of the main cartridge, both cartridges being detachable from the body of the apparatus, and in which a developing agent bearing member of each of the developing units in the main cartridge and the sub-cartridge is disposed in no contact with the image bearing member in the main cartridge, a contact member for adjusting the interval between the image bearing member and the developing agent bearing member to a predetermined value is mounted in the main cartridge. Therefore, it is possible to always maintain a constant interval between the image bearing member and the developing agent bearing member with high accuracy, and thus to stably obtain a high-quality color image.

Although an apparatus which forms a multi-color image with yellow, magenta, cyan and black developing agents is illustrated in this embodiment, for example, an apparatus which uses a black developing agent, and monochromatic, such as red and blue, developing agents each contained in a detachable cartridge, and which forms a multiple image on a transfer material with these monochromatic developing agents and the black developing agent, may be also used.

Furthermore, the main cartridge of the present invention may be a combination of a photoconductive member, a charger and a developing device, of a photoconductive member and a developing member, or of a photoconductive member, a developing device and a cleaning device, and is not limited to the main cartridge described in this embodiment.

Furthermore, although an image is formed by superposing developed images one by one on a transfer material in this embodiment, the present invention is applicable to an apparatus which produces a multiple image on a photoconductive member and then transfers the multiples image on a transfer material.

What is claimed is:

1. A process cartridge detachably mountable on a body of an image forming apparatus, said process cartridge comprising:

an image carrier;

developing means for forming a visible image on said image carrier, said developing means including a developing agent bearing member for supplying a developing agent to said image carrier;

a first support member supporting said image carrier, said first support member comprising a positioning portion, distinct from said image carrier, directly contacting and positioning said developing agent bearing member; and a second support member supporting said developing means, said second support member formed separately from said first support member.

2. A process cartridge according to claim 1, wherein said positioning portion is disposed outside an image forming region on said image carrier as viewed in a longitudinal direction of said image carrier.

3. A process cartridge according to claim 2, wherein said positioning portion includes a member separate from said first support member and fixed to an outer side of said first support member outside the image forming region on said image carrier as viewed in the longitudinal direction of said image carrier.

4. A process cartridge according to claim 3, wherein said positioning portion includes an adjusting member for adjusting a gap formed between said image carrier and said developing agent bearing member.

5. A process cartridge according to claim 1, wherein said first support member positions both ends of said developing agent bearing member in a longitudinal direction of said image carrier.

6. A process cartridge according to claim 1, wherein said image carrier includes a photosensitive member, and wherein said developing agent bearing member includes a developing roller which conveys the developing agent to said photosensitive member.

7. A process cartridge according to claim 6, further comprising charging means for electrostatically charging said photosensitive member and cleaning means for cleaning said photosensitive member.

8. A process cartridge according to claim 6, wherein the developing agent is a toner, and wherein said developing means includes a toner container containing the toner.

9. A process cartridge according claim 1, wherein said image carrier has a drum-like shape.

10. A process cartridge according to claim 9, further comprising a rotary shaft for supporting said image carrier for rotation, wherein said positioning portion is formed separately from said first support member and positions said rotary shaft and said developing agent bearing member.

11. A process cartridge according to claim 1, wherein said developing means is a jumping developing means which develops an image by causing the developing agent to jump from said developing agent bearing member to said image carrier.

12. A process cartridge according to claim 1, wherein a predetermined gap is formed between said image carrier and said developing agent bearing member.

13. A process cartridge according to claim 1, wherein said second support member is detachable from said first support member.

14. A process cartridge according to claim 1, wherein said first support member and said second support member are independently detachable from the body of said image forming apparatus.

15. A process cartridge according to claim 1, wherein a surface of said positioning portion contactable with said developing agent bearing member comprises fluororesin.

16. A process cartridge according to claim 7, further comprising a plurality of developing means separate from said first support member, wherein said first support member comprises a plurality of positioning portions for positioning each said developing agent bearing member of each of the respective plurality of developing means.

17. A process cartridge according to claim 16, wherein said plurality of developing means contain color toners.

18. A process cartridge according to claim 17, wherein the color toners include yellow, magenta and cyan color toners.

19. A process cartridge according to claim 1, wherein said first support member supports at least one of a plurality of developing means different from said developing means supported by said second support member.

20. A process cartridge according to claim 19, wherein the at least one of a plurality of developing means supported by said first support member contains a color toner.

21. A process cartridge according to claim 20, wherein the color toner is one of yellow toner, magenta toner and cyan toner.

22. A process cartridge according to claim 19, wherein said developing means supported by said second support member formed separately from said first support member contains a black toner.

23. An image forming apparatus capable of mounting a process cartridge, said apparatus comprising:

a mounting portion mounting said process cartridge, wherein said process cartridge comprises:

an image carrier;

developing means for forming a visible image on said image carrier, said developing means including a developing agent bearing member for supplying a developing agent to said image carrier;

a first support member supporting said image carrier, said first support member comprising a positioning portion, distinct from said image carrier, directly contacting and positioning said developing agent bearing member; and a second support member supporting said developing means, said second support member formed separately from said first support member.

24. An image forming apparatus according to claim 23, wherein said positioning portion is disposed outside an image forming region on said image carrier as viewed in longitudinal direction of said image carrier.

25. An image forming apparatus according to claim 24, wherein said positioning portion includes a member separate from said first support member and fixed to an outer side of said first support member outside the image forming region on said image carrier as viewed in the longitudinal direction of said image carrier.

26. An image forming apparatus according to claim 25, wherein said positioning portion includes an adjusting member for adjusting a gap formed between said image carrier and said developing agent bearing member.

27. An image forming apparatus according to claim 23, wherein said first support member position both ends of said developing agent bearing member in a longitudinal direction of said image carrier.

28. An image forming apparatus according to claim 23, wherein said image carrier includes a photosensitive member, and wherein said developing agent bearing member includes a developing roller which conveys the developing agent to said photosensitive member.

29. An image forming apparatus according to claim 28, wherein said process cartridge further comprises charging means for electrostatically charging said photosensitive member and cleaning means for cleaning said photosensitive member.

30. An image forming apparatus according to claim 28, wherein the developing agent is a toner, and wherein said developing means includes a toner container containing the toner.

31. An image forming apparatus according to claim 23, wherein said image carrier has a drum-like shape.

32. An image forming apparatus according to claim 31, wherein said process cartridge has a rotary shaft for supporting said image carrier for rotation, and wherein said positioning portion is formed separately from said first support member and positions said rotary shaft and said developing agent bearing member.

33. An image forming apparatus according to claim 23, wherein said developing means is a jumping developing means which develops an image by causing the developing agent to jump from said developing agent bearing member to said image carrier.

34. An image forming apparatus according to claim 33, wherein a predetermined gap is formed between said image carrier and said developing agent bearing member.

35. An image forming apparatus according to claim 23, wherein said second support member is detachable from said first support member.

36. An image forming apparatus according to claim 23, further comprising means for detachably and independently mounting said first support member and said second support member.

37. An image forming apparatus according to claim 23, wherein surface of said positioning portion contactable with said developing agent bearing member comprises a fluororesin.

38. An image forming apparatus according to claim 23, wherein said process cartridge further comprises a plurality of developing means separate from said first support member, wherein said first support member comprises a plurality of positioning portions for positioning said developing agent bearing member of each of the respective plurality of developing means.

39. An image forming apparatus according to claim 38, wherein said plurality of developing means contain color toners.

40. An image forming apparatus according to claim 39, wherein the color toners include yellow, magenta and cyan color toners.

41. An image forming apparatus according to claim 23, wherein said first support member supports at least one of a plurality of developing means different from said developing means supported by said second support member.

42. An image forming apparatus according to claim 41, wherein the at least one of a plurality of developing means supported by said first support member contains a color toner.

43. An image forming apparatus according to claim 42, wherein the color toner is one of yellow toner, magenta toner and cyan toner.

44. An image forming apparatus according to claim 41, wherein said developing means supported by said second support member contains a black toner.

45. A detachably mountable process cartridge for use with a sub-cartridge that includes a developing unit support member and a developing unit having a developing agent bearing member, said process cartridge comprising:

an image carrier; and an image carrier support member supporting said image carrier, said image carrier support member comprising a positioning member, the positioning member being configured and arranged to directly contact and position the developing agent bearing member of the sub-cartridge when the sub-cartridge is positioned adjacent to said process cartridge.

* * * * *

UNITED STATES PATENT AND TRADEMARK OFFICE

CERTIFICATE OF CORRECTION

PATENT NO. : 5,442,421

DATED : August 15, 1995

INVENTOR(S) : Hisayoshi Kojima

It is certified that error appears in the above-indentified patent and that said Letters Patent is hereby corrected as shown below:

COLUMN 1:

Line 31, "of" should be deleted.

COLUMN 2:

Line 37, "application of" should be deleted;
Line 38, "the" (first occurrence) should be deleted; and
Line 49, "the" (second occurrence) should be deleted.

COLUMN 5:

Line 28, "PTFE" should read --PTEF--.

COLUMN 6:

Line 28, "rotatably" should read --rotatably mounted--; and
Line 50, "used" should read --used,--.

COLUMN 7:

Line 66, "ples" should read --ple--.

COLUMN 8:

Line 61, "claim 1," should read --claim 11,--;

UNITED STATES PATENT AND TRADEMARK OFFICE

CERTIFICATE OF CORRECTION

PATENT NO. : 5,442,421

DATED : August 15, 1995

INVENTOR(S) : Hisayoshi Kojima

It is certified that error appears in the above-indentified patent and that said Letters Patent is hereby corrected as shown below:

COLUMN 9:

Line 7, "claim 7," should read --claim 1,--;
Line 55, "in" should read --in a--; and
Line 68, "position" should read --positions--.

COLUMN 10:

Line 43, "wherein" should read --wherein a--.

Signed and Sealed this

Twenty-sixth Day of December, 1995

*Attest:*

*Attesting Officer*

Bruce Lehman

BRUCE LEHMAN

*Commissioner of Patents and Trademarks*